United States Patent [19]

Karstensen

[11] 4,150,915

[45] Apr. 24, 1979

[54] VARIABLE GEOMETRY TURBINE NOZZLE

[75] Inventor: Karl W. Karstensen, Peoria, Ill.

[73] Assignee: Caterpillar Tractor Co., Peoria, Ill.

[21] Appl. No.: 730,044

[22] Filed: Dec. 23, 1976

[51] Int. Cl.[2] ..... F01B 25/10; F01D 17/16; F01D 25/26; F16K 31/44

[52] U.S. Cl. ..... 415/139; 415/160; 251/249.5; 251/286

[58] Field of Search ..... 415/160, 159, 139, 138, 415/136, 161, 162; 60/39.32; 251/248, 249.5, 286; 74/98

[56] References Cited

U.S. PATENT DOCUMENTS

| | | | |
|---|---|---|---|
| 2,651,492 | 9/1953 | Feilden | 415/160 |
| 3,224,194 | 12/1965 | DeFeo et al. | 415/160 UX |
| 3,685,921 | 8/1972 | Dekeyser | 415/159 |
| 3,904,309 | 9/1975 | Keetley | 415/160 X |
| 3,976,394 | 8/1976 | Tarter et al. | 415/217 X |
| 3,995,971 | 12/1976 | White | 415/160 |
| 4,003,675 | 1/1977 | Stevens et al. | 415/160 X |
| 4,030,288 | 6/1977 | Davis et al. | 60/39.32 X |

*Primary Examiner*—Carlton R. Croyle
*Assistant Examiner*—Donald S. Holland
*Attorney, Agent, or Firm*—Phillips, Moore, Weissenberger, Lempio & Majestic

[57] ABSTRACT

The invention is concerned with an improvement in a movable vane assembly of the type used in a gas turbine engine or compressor for interaction with a gas stream comprising a plurality of radially aligned vanes, generally of an air foil configuration, circumferentially arranged within an annular passage formed by a housing, said vanes being supported for rotation about their radial axis to vary the effective cross-sectional area of said annular passage, a plurality of rotatable gear means connected for rotation with said aligned vanes and a ring gear having teeth means adapted for simultaneous engagement with the teeth means of said rotatable gear means such that rotation of said ring gear causes rotation of said vanes. In one sense the improvement comprises a support for the ring gear supportingly connected to the first housing inwardly radially and coaxial with the ring gear, the support comprising an annular ring having longitudinally extending slot means therein. In another sense, the improvement is in a movable vane assembly as set out above which includes an outer shroud supportingly connected to the housing and an inner shroud radially inwardly spaced from the outer shroud. In this other sense, the improvement comprises a plurality of circumferential thrust segments having a well therein generally centrally thereof, adjacent of said segments having overlapping means, said segments fitting together to form a close fitting shroud for the inner ends of said vanes; a plurality of extending members, one proceeding inwardly radially along the rotational axis from each of said vanes, said extending member each being rotatably located within a respective one of said well and a collar extending from said inner shroud inwardly radially of said shroud in supporting relation thereto. In yet another sense the removable vane assembly includes a plurality of link means for actuating the ring gear and the improvement comprises using as each of said link means a pin with an eccentric flange extending centrally therefrom and including as part of said ring gear a plurality of recesses which mate with said eccentric flanges whereby said pins are removable from said ring gear using a single wrench.

17 Claims, 8 Drawing Figures

VARIABLE GEOMETRY TURBINE NOZZLE

BACKGROUND OF THE INVENTION

1. Field of the Invention

The invention is concerned with movable vane assemblies of the type used in gas turbine engines or compressors for interaction with a gas stream. In such assemblies a plurality of radially aligned vanes are circumferentially arranged within an annular passage formed by a housing. The vanes are supported for rotation about their radial axis to vary the effective cross-sectional area of the annular passage. A plurality of rotatable gear means are connected for rotation with the aligned vanes and a ring gear is provided having teeth means adapted for simultaneous engagement with the teeth means of the rotatable gear means such that rotation of the ring gear causes rotation of the vanes. More particularly the invention is concerned with improvements in such an assembly.

2. Prior Art

The prior art discloses variable geometry turbine nozzles in which vanes are cantilevered from shafts which rotate in bushings supported by an outer housing of an engine. Actuation generally proceeds via a spur gear sector which is attached to an outer end of each of the shafts of the vanes. The gears and vanes are driven by a face gear which is often made integral with the outer shaft of a large diameter ball bearing. The inner race of this ball bearing is generally mounted to the engine case. The vanes are located radially by thrust surfaces in the outer shroud of the nozzle. The outer shroud is mounted to the engine housing through a spline having the necessary radial freedom to allow the relatively hot outer shroud to expand outward relative to the cooler engine case. The outer shroud is sealed to the engine case by a metal piston-ring seal. Pressure forces acting in a downstream direction on the inner shroud of the nozzle are transmitted to the outer shroud through a series of pheripheral air foil shaped struts which cross the nozzle inlet duct. The clearance between the vanes and the inner shroud must be made sufficiently large so that it does not close completely and prevent rotation of the vanes when the engine is first started and the vanes reach their operating temperature much more rapidly than do the shrouds. This creates a disadvantage in that a large portion of this clearance reoccurs when the shrouds reach their final generally vane equal operating temperature. This excess clearance causes an undesirable reduction in the aerodynamic efficiency of the turbine stage.

The abovementioned vane clearance problem can be solved by using a nozzle having an additional shaft and thrust surface added to the inner end of the vanes co-linear with those on the outer end thereof. The inner shroud of such a nozzle is made of a series, one per vane, of circumferential segments. The clearance between the vanes and the spherical outer surface of the segments is maintained by close dimensional control of thrust surfaces on the vane, the shroud segment, and a retaining collar for the shroud segment. In such an apparatus, the shroud segment moves radially with thermal expansion of the vanes while maintaining a constant clearance with the edge of the vanes. Circumferential movement of the inner and outer shrouds relative to each other is provided for by stepped edges on the segments which overlap each other. As the ring of inner shroud segments changes its diameter sealing with the inner shroud is effected by a pair of metal piston-ring seals. This design uses the vanes themselves to support the inner shroud and to transmit the downstream pressure load acting upon the inner shroud to the outer shroud. This eliminates the struts in the inlet annulus but causes a substantial increase in actuation force required due to the additional bushing loads imposed by the inner shroud pressure load. A further increase in friction and therefore actuation force can be caused by misalignment of inner shroud vane bores with those in the outer shroud as a result of manufacturing inaccuracy.

The present invention provides a variable geometry turbine nozzle which has none of the disadvantages of the above-mentioned prior art variable geometry turbine nozzles.

SUMMARY OF THE INVENTION

In a first sense, the invention comprises an improvement in a movable vane assembly of the type used in a gas turbine engine or compressor for interaction with a gas stream comprising a plurality of radially aligned vanes, generally of an air foil configuration, circumferentially arranged within an annular passage formed by a housing, the vanes being supported for rotation about their radial axis to vary the effective cross-sectional area of the annular passage, a plurality of rotatable gear means connected for rotation with said aligned vanes and a ring gear having teeth means adapted for simultaneous engagement with the teeth means of said rotatable gear means such that rotation of said ring gear causes rotation of said vanes. The improvement in this sense comprises a support for the ring gear supportingly connected to the housing inwardly radially of and coaxial with the ring gear, the support comprising an annular ring having longitudinally extending slot means therein and link means for actuating the ring gear.

In another sense, the invention comprises an improvement in a movable vane assembly of the type just mentioned, which vane assembly also includes an outer shroud supportingly connected to the housing and an inner shroud radially inwardly spaced from the outer shroud. In this sense the improvement comprises a plurality of circumferential thrust segments in one to one relation with the plurality of vanes, each of the segments having a well therein generally centrally thereof, adjacent of said segment having overlapping means, said segments fitting together to form a closely fitting shroud; a plurality of extending members, one proceeding inwardly radially along the rotational axis of each of said vanes, said extending members each being in rotatable relation with a respective one of said segments within a respective one of said wells; and a collar extending from said inner shroud inwardly radially of said support shroud in supporting relation thereto.

In yet another sense the invention comprises an improvement in a movable vane assembly of the type used in a gas turbine engine or compressor for interaction with a gas stream and comprising a plurality of radially aligned vanes circumferentially arranged within an annular passage formed by a housing, said vanes being supported for rotation about their radial axis to vary the effect of cross-sectional area of said annular passage, a plurality of rotatable gear means connected for rotation with said aligned vanes, a ring gear having teeth means adapted for simultaneous engagement with the teeth means of said rotatable gear means such that rotation of said ring gear causes rotation of said vanes, and a plurality of link means for activating said ring gear. The improvement in this sense comprises using as each of said link means a pin with an eccentric flange extending centrally therefrom and including as part of said ring gear a plurality of recesses which mate with said eccentric flanges whereby said pins are removable from said ring gear using a single wrench.

BRIEF DESCRIPTION OF THE DRAWINGS

The invention will be better understood by reference to the figures of the drawing wherein like numbers denote like parts throughout and wherein.

DETAILED DESCRIPTION OF THE PREFERRED EMBODIMENT

The variable geometry turbine nozzle improvement of the present invention is useful in gas turbine engines or compressors. One such gas turbine engine in which it is useful is disclosed in detail in co-pending application Ser. No. 630,476 filed Nov. 10, 1975 now U.S. Pat. No. 4,030,288, issued June 21, 1977, and commonly assigned herewith. The description of a gas turbine engine as included in said application Ser. No. 630,476 is hereby referred to and incorporated herein by reference thereto.

Figure 1:
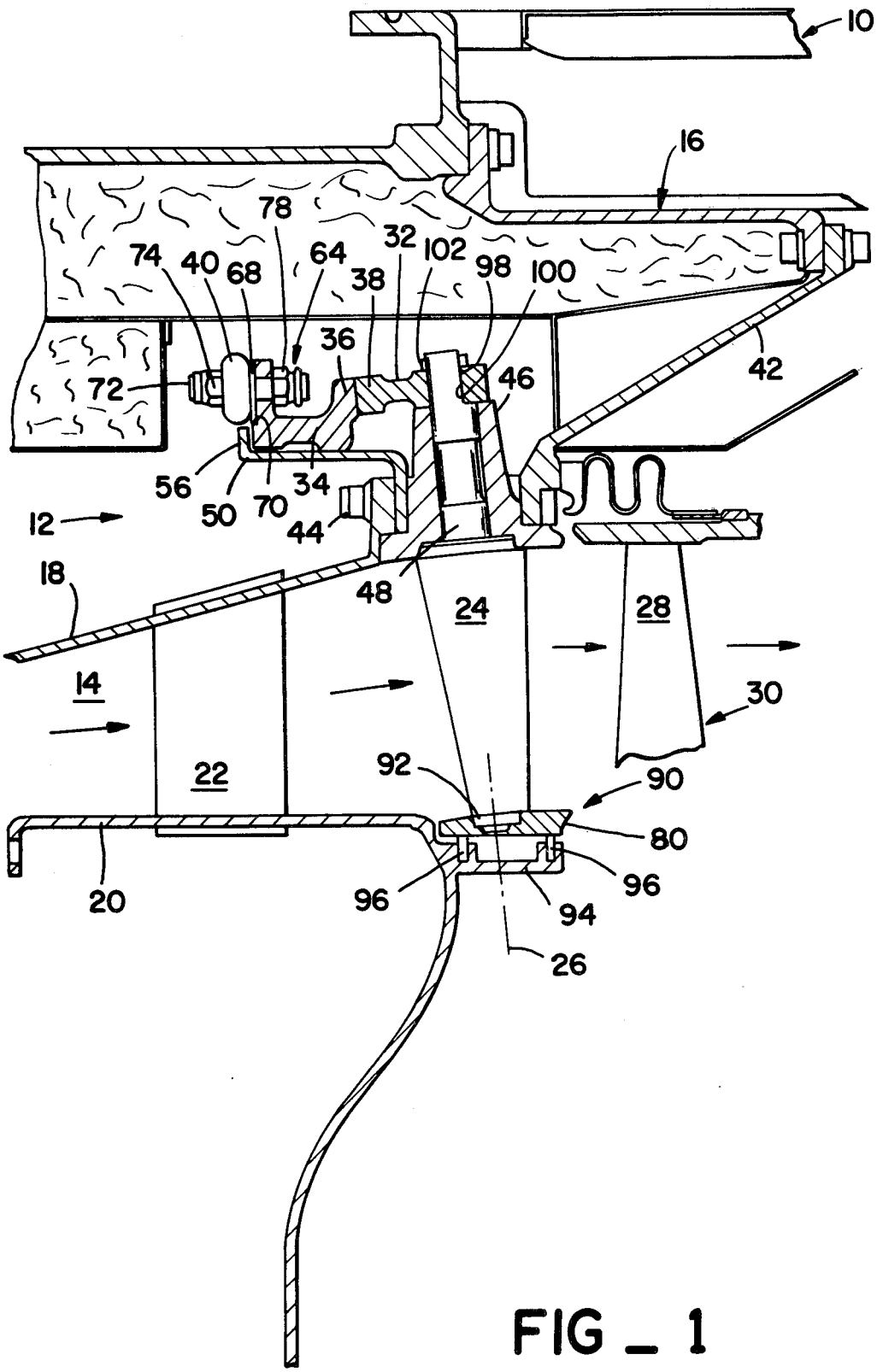
FIG. 1 illustrates in partial side section a variable geometry turbine nozzle in accordance with the present invention.

Turning to FIG. 1 there is illustrated therein in partial view a gas turbine engine 10 and more particularly a turbine nozzle section 12 thereof. The turbine nozzle section 12 receive hot gases from a combustor (not illustrated) after they have passed a gasifier turbine portion of the turbine engine in a manner described in the aforementioned patent application Ser. No. 630,476. A gas stream then flows within an annular passage 14 formed by an outer shroud 18 and an inner shroud 20 which are supportably connected together by a plurality of struts 22 each of which is aerodynamically shaped for minimum resistance to air flow. The gases then proceed past a plurality of aligned vanes 24, generally of an air foil configuration, which are circumferentially arranged within the annular passage 14.

The vanes 24 are supported for rotation about their radial axis 26 to thereby vary the effective cross-sectional area of the annular passage 14. As the gases pass through the annular passage 14 and pass the plurality of radially aligned vanes 24 they then flow past the blades 28 of a turbine such as a power turbine 30.

A plurality of rotatable gear means, in the embodiment illustrated a plurality of segment gears 32 are connected for rotation with the radially aligned vanes 24. A ring gear 34 having teeth means 36 is arranged for simultaneous engagement with teeth means 38 of the rotatable plurality of segment gears 32 such that rotation of the ring gear 34 causes rotation of the vanes 24. In this manner the effective cross-sectional area of the annular passage 14 can be varied through controlled rotation of the ring gear 34. Generally, the ring gear 34 can be motivated to move by any of a number of mechanisms. For example, U.S. patent application Ser. No. 609,764, now U.S. Pat. No. 4,003,675, which is commonly assigned herewith discloses mechanisms which will accomplish such actuation of the ring gear 34. In the embodiment illustrated herein, a plurality, generally a pair, of link means 40 communicating peripherally on the ring gear 34 and spaced generally diametrically from one another serve to actuate the ring gear 34.

As will be noted by reference primarily to FIG. 1, the outer shroud 18 is integrally supported as part of the housing 16 via an inwardly extending flange 42, bolt means 44 and a plurality of bearings 46 each of which rotatingly holds a shaft 48 which extends radially outwardly along the axis 26 of each respective one of the vanes 24. Thus, each of the plurality of bearing 46 is supportingly connected to the first housing via the inwardly extending flange 42 and bolt means 44. The outer shroud 18 is supportingly connected to the plurality of bearing 46 via the same bolt means 44. This provides co-acting movement of the outer shroud 18 and the vanes 24 and assures rigidity and stability to the entire structure.

Figure 5:
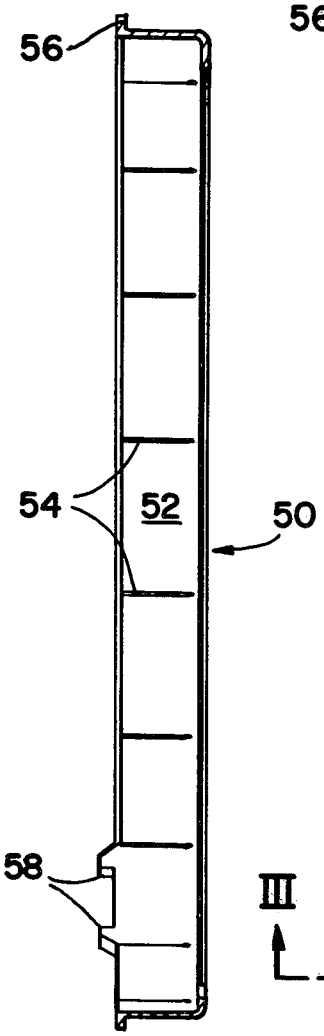
FIG. 5 illustrates in reduced size a portion of the variable geometry turbine nozzle of the present invention.
Figure 6:
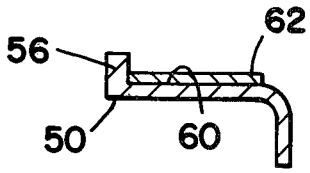
FIGS. 6 and 7 illustrate in further detail alternate structures of the variable geometry turbine nozzle of the present invention.
Figure 7:
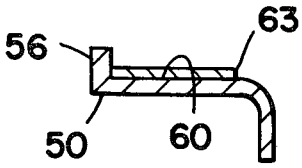

Also supported by the bearings 46 and the bolt means 44 is a support 50 shown in greatest detail in FIGS. 5–7. The support 50 serves to support the ring gear 34 and is supportingly connected to the housing 16 in the manner just described inwardly radially and coaxial with the ring gear 34. The support 50 as will be noted clearly by reference to FIG. 5 comprises an annular ring 52 having longitudinally extending slot means 54 therein. The longitudinally extending slot means or slots 54 allow for expansion and contraction of the support 50 as hot exhaust gases heat the outer shroud 18 and thereby heat the support 50. The support 50 further includes along with the annular ring 52 a shoulder 56 extending outwardly radially therefrom adjacent the ring gear 34 and in position to resist separation of the ring gear teeth means 36 from the teeth means 38 of the plurality of segment gears 32. Thus, the shoulder 56 is on a side of the annular ring 52 removed from the interlocking teeth means 36 and 38. The support 50 can preferably include a plurality, generally a pair of stop means 58 extending therefrom adjacent the shoulder 56 to provide a pair of fixed opening positions for the vanes 24. Briefly, the stop means 58 set up two specific fixed opening positions for the vanes 24. A pin can be inserted through an opposing hole in the ring gear 34 and the mechanism can then be rotated until the pin is against one or the other of the stop means 58 under the impetus of the link means 40. This sets the nozzle vanes 24 in one of two known positions for calibration of associated electronic control systems. The support 50 is either formulated of a material having relatively low co-efficient of friction at the operating temperature of the engine as illustrated in FIGS. 1 and 5 or the outer surface 60 of the support 50 is coated with a low friction material 62 which has good stability at the operating temperature of the engine. For example, the outer surface 60 of the annular ring 52 can be coated if desired with a low friction high temperature resistant fluorocarbon polymer such as polymerized tetrafluoroethylene or the like as is illustrated in FIG. 6 or with a low friction metal bushing 63 as illustrated in FIG. 7. In this manner the surface coating 62 or bushing 63 is secured or bonded to the outer surface 60 of the annular ring 52.

Figure 8:
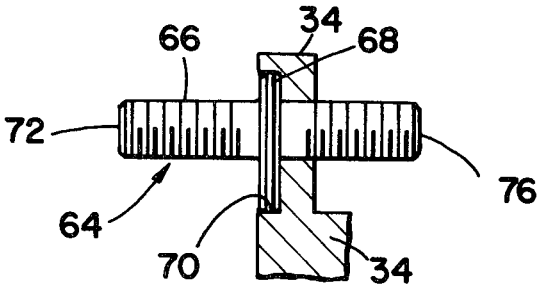
FIG. 8 illustrates a partial sectional view of the rotatable ring gear having pin means assembled before link means are placed thereon.
Figure 2:
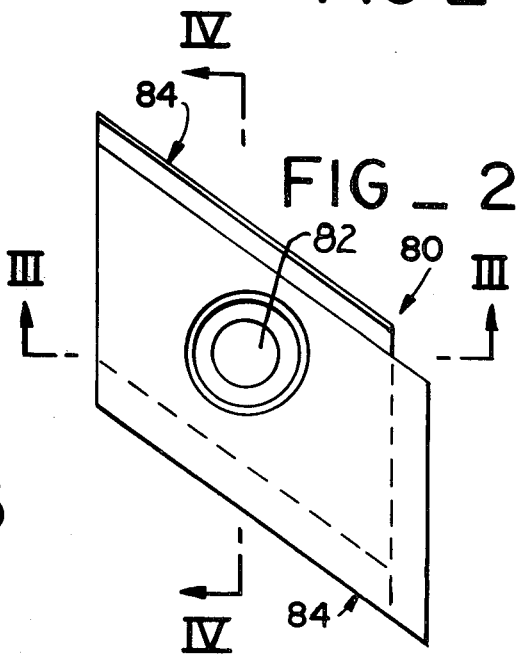
FIG. 2 illustrates one of a plurality of segments which form a portion of said nozzle.
Figure 4:
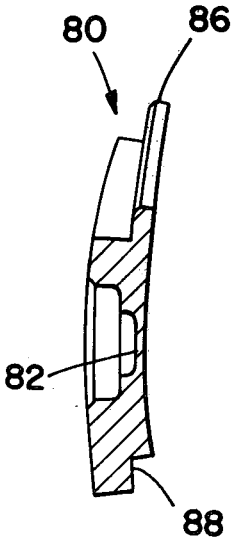
FIG. 4 illustrates a view taken along the line IV—IV of FIG. 2.
Figure 3:
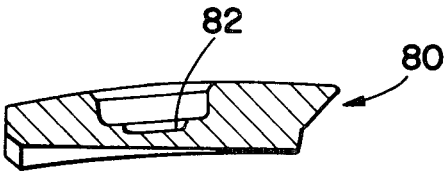
FIG. 3 illustrates a view taken along the line III—III of FIG. 2.

Connection of the link means 40 to the ring gear 34 can be accomplished in any of a number of manners but the preferred manner of accomplishing this is illustrated most clearly by reference to FIGS. 1 and 8. As illustrated therein pin means 64 serve to connect the link means 40 to the ring gear 34. The pin means 64 preferably comprises a pin 66 with an eccentric flange 68 extending centrally outwardly radially therefrom. The ring gear 34 preferably includes a recess 70 which mates with the eccentric flange 68 and holds the eccentric flange 68 therewithin. A first end 72 of the stud 66 passes through a respective one of the link means 40 and is attached thereto through use of a first nut 74. A second end 76 of the stud 66 passes through the ring gear 34 and is attached thereto by a second nut 78. Because of the eccentric character of the flange 68 and the mating shape of the recess 70 in the ring gear 34 either the first nut 74 or the second nut 78 can be removed using a single wrench since the eccentric flange 68 will bind within the recess 70. This allows disconnecting of either the link means 70 or the ring gear 74 from the stud 66 in a simple manner and without the necessity for large clearances being provided within the housing 16 as might be required if it was necessary to use two wrenches to accomplish the disconnecting of the stud 66.

Referring now to FIGS. 1-4 there is illustrated therein a plurality of circumferential thrust segments 80 which are in one to one relation with the plurality of vanes 24. Each of the segments 80 has a well 82 therein generally centrally thereof. Adjacent of the segments 80 are overlapping means 84 comprising generally a lip 86 and a cut out 88 one adjacent each end of each of the segments 80. The segments 80 fit together overlappingly with each respective lip 86 within the next adjacent cut out 88 to form a close fitting shroud 90. A plurality of extending members 92 are provided, one proceeding inwardly radially along the rotational axis 26 of each of the vanes 24. Each of the extending members 92 is located within a respective one of the walls 82. A collar 94 is provided which extends from and is supported by the inner shroud 20. The collar 94 extends inwardly radially of the close fitting shroud 90 in supporting relation thereto. Generally, there is included compressible support ring means such as for example the compressible support rings 96 intermediate the collar 94 and the close fitting shroud 90. As have been previously mentioned, the plurality of struts 22 are in the annular passage 14 and serve to rigidly connect the inner shroud 20 to the outer shroud 18 whereby the plurality of bearings 46 move with the collar 94 and hence generally with the close fitting shroud 90. Through use of the compressible ring supports 96 and the plurality of segments 80 to form the close fitting support shroud 90 the clearance between the respective vanes 24 and the respective segments 80 is kept constant even as different parts of the engine heat at different rates and/or to different temperatures.

It will be noted that the improved variable geometry turbine nozzle of the present invention allows the use of a relatively short shaft as the shaft 48 since the struts 22 are used to support the inner shroud 20 relative to the outer shroud 18 and thus the shafts 48 do not have to bear the forces supporting the inner shroud 20 to the outer shroud 18 as in one prior art design discussed previously. It will further be noted that the shafts 48 of the vanes 24 can be relatively straightforwardly connected to the plurality of segment gears 32 as by simply providing a simple flat surface 98 on each of the shafts 48 which mates with a flat surface 100 on each of the segment gears 32. A simple headed pin 102 can simply be forced into an appropriate bore which passes through the respective shaft 48 and can then be riveted over at one end thereof.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a movable vane assembly of the type used in a gas turbine engine or compressor for interaction with a gas stream comprising a plurality of radially aligned vanes circumferentially arranged within an annular passage formed by a housing, said vanes being supported for rotation about their radial axis to vary the effective cross-sectional area of said annular passage, a plurality of rotatable gear means connected for rotation with said aligned vanes, a ring gear having teeth means adapted for simultaneous engagement with teeth means of said rotatable gear means such that rotation of said ring gear causes rotation of said vanes, an outer shroud supportingly connected to said housing and an inner shroud radially inwardly spaced from said outer shroud, an improvement comprising:

a plurality of circumferential thrust segments in one to one relation with said plurality of vanes, each of said segments having a well therein generally centrally thereof, adjacent ones of said segments having overlapping means, said segments fitting together via said overlapping means to form a close fitting shroud;

a plurality of extending members, one proceeding inwardly radially along the rotational axis of each of said vanes, said extending members each being in rotatable supporting relation with a respective one of said segments within a respective one of said wells; and a collar extending from said inner shroud inwardly radially of said close fitting shroud in supporting relation thereto.

2. An improvement as in claim 1, including a plurality of struts in said annular passage rigidly connecting said inner and outer shrouds.

3. An improvement as in claim 2, including compressible support ring means intermediate said collar and said close fitting shroud.

4. An improvement as in claim 2, including a support for said ring gear supportingly connected to said housing inwardly radially of and coaxial with said ring gear, said support comprising an annular ring having longitudinally extending slot means therein.

5. An improvement as in claim 4, wherein said support further includes a shoulder extending outwardly radially therefrom adjacent said ring gear in position to resist separation of said ring gear teeth means from said rotatable gear means teeth means.

6. An improvement as in claim 5, wherein said support includes a pair of stop means extending therefrom to provide a pair of fixed opening positions for said vanes.

7. An improvement as in claim 6, wherein said annular ring is supportingly connected to said housing via a plurality of bearings each of which rotatingly holds a shaft extending radially outwardly along the rotational axis of a respective one of said vanes and each of said bearings is supportingly connected to said housing.

8. An improvement as in claim 7, including link means for actuating said ring gear.

9. An improvement as in claim 8, including pin means connecting said link to said ring gear.

10. An improvement as in claim 9, wherein said pin means comprises a pin with an eccentric flange extending outwardly centrally therefrom and wherein said ring gear includes a recess which mates with said eccentric flange.

11. In a movable vane assembly of the type used in a gas turbine engine or compressor for interaction with a gas stream comprising a plurality of radially aligned vanes circumferentially arranged within an annular passage formed by a housing, said vanes being supported for rotation about their radial axes to vary the effective cross-sectional area of said annular passage, a plurality of rotatable gear means connected for rotation with said aligned vanes, and a ring gear having teeth means adapted for simultaneous engagement with teeth means of said rotatable gear means such that rotation of said ring gear causes rotation of said vanes, an improvement comprising a support for said ring gear supportingly connected to said housing inwardly radially of and coaxial with said ring gear, said support comprising an annular ring having longitudinally extending slot means therein and link means for actuating said ring gear.

12. An improvement as in claim 11, wherein said support further includes a shoulder extending outwardly radially therefrom adjacent to said ring gear in position to resist separation of said ring gear teeth means from said rotatable gear means teeth means.

13. An improvement as in claim 12, wherein said support includes a pair of stop means extending therefrom to provide a pair of fixed opening positions for said vanes.

14. An improvement as in claim 13, wherein said annular ring is supportingly connected to said housing via a plurality of bearings each of which rotatingly holds a shaft extending radially outwardly from a respective one of said vanes along the rotational axis thereof and each of said bearings is supportingly connected to said housing.

15. An improvement as in claim 11, including pin means connecting said link means to said ring gear.

16. An improvement as in claim 15, wherein said pin means comprises a pin with an eccentric flange extending outwardly centrally therefrom and wherein said ring gear includes a recess which mates with said eccentric flange.

17. In a movable vane assembly of the type used in a gas turbine engine or compressor for interaction with a gas stream comprising a plurality of radially aligned vanes circumferentially arranged within an annular passage formed by a housing, said vanes being supported for rotation about their radial axis to vary the effective cross-sectional area of said annular passage, a plurality of rotatable gear means connected for rotation with said aligned vanes, a ring gear having teeth means adapted for simultaneous engagement with teeth means of said rotatable gear means such that rotation of said ring gear causes rotation of said vanes and a plurality of link means for actuating said ring gear, an improvement wherein each of said link means comprises a pin with an eccentric flange extending centrally therefrom and wherein said vane assembly includes as part of said ring gear a plurality of recesses which mate with said eccentric flanges.

* * * * *